United States Patent [19]

Yoerger

[11] 4,145,214

[45] Mar. 20, 1979

[54] CO-CRYSTALLINE ORGANIC PHOTOCONDUCTORS AND HETEROGENEOUS COMPOSITIONS THEREOF

[75] Inventor: William E. Yoerger, Rochester, N.Y.

[73] Assignee: Eastman Kodak Company, Rochester, N.Y.

[21] Appl. No.: 800,509

[22] Filed: May 25, 1977

[51] Int. Cl.[2] ..... G03G 5/06

[52] U.S. Cl. ..... 96/1 PC; 260/707; 96/1.5 R

[58] Field of Search ..... 96/1.5, 1 PC; 260/707

[56] References Cited

U.S. PATENT DOCUMENTS

| | | | |
|---|---|---|---|
| 2,765,385 | 10/1956 | Thomsen | 338/15 |
| 3,287,123 | 11/1966 | Hoegl | 96/1 S |

OTHER PUBLICATIONS

Fox et al., Phys. & Chem. of Organic Solid State, vol. II, (1967), Intersci., pp. 64–69, 74, 75.

Doremus et al., Growth and Purification of Crystals., J. Wiley & Sons, (1959), pp. 404–406.

*Primary Examiner*—John D. Welsh

*Attorney, Agent, or Firm*—T. N. Dahl

[57] ABSTRACT

Co-crystalline organic photoconductor compositions comprising p-terphenyl doped with 1 to 15 percent of p-quaterphenyl useful for electrophotographic elements.

18 Claims, No Drawings

CO-CRYSTALLINE ORGANIC PHOTOCONDUCTORS AND HETEROGENEOUS COMPOSITIONS THEREOF

BACKGROUND OF THE INVENTION

1. Field of the Invention

This invention relates to polyphenyl photoconductors. More specifically, it relates to co-crystalline photoconductors comprising p-terphenyl doped with p-quaterphenyl and the use of such photoconductors in heterogeneous photoconductive insulating compositions.

2. Discussion of Related Art

The process of xerography, as disclosed by Carlson in U.S. Pat. No. 2,297,691 (issued Oct. 6, 1942) employs an element having a support bearing a coating of a normally insulating material whose electrical resistance varies with the amount of incident electromagnetic radiation it receives. The element, commonly termed a photoconductive element, is first given a uniform surface charge, generally in the dark after a suitable period of dark adaptation. It is then exposed to a pattern of actinic radiation which has the effect of differentially reducing the potential of this surface charge in accordance with the relative energy contained in various parts of the radiation pattern. The differential surface charge or electrostatic latent image remaining on the electrophotographic element is then made visible by contacting the surface with a suitable electroscopic marking material. Such marking material or toner whether contained in an insulating liquid or on a dry carrier, can be deposited on the exposed surface in accordance with either the charge pattern or discharge pattern as desired. Deposited marking material can then be either permanently fixed to the surface of the sensitive element by known means such as heat, pressure, solvent vapor, or the like, or transferred to a second element to which it can similarly be fixed. Likewise, the electrostatic latent image can be transferred to a second element and developed there.

Various photoconductive insulating materials have been employed in the manufacture of electrophotographic elements. For example, vapors of selenium and vapors of selenium alloys deposited on a suitable support, and particles of photoconductive zinc oxide dispersed in resinous, film-forming binder have found wide application in the present-day document copying applications.

Since the introduction of electrophotography, a great many organic compounds have also been screened for their photoconductive properties. As a result, a very large number of organic compounds have been shown to possess some degree of photoconductivity. Many organic compounds have revealed a useful level of photoconduction and have been incorporated into photoconductive compositions.

In photoconductive insulating compositions using organic photoconductors, the photoconductor, if not polymeric, is usually carried in a film-forming binder. Typical binders are polymeric materials having fairly high dielectric strength such as phenolic resins, ketone resins, acrylic ester resins, polystyrenes and the like. A more comprehensive listing of binders appears in U.S. Pat. No. 3,755,310 (issued Aug. 28, 1973 to L. J. Rossi). The photoconductor can be dissolved with the binder to prepare a homogeneous photoconductive composition in a common solvent. In another aspect, it can be provided as a dispersion of small particles in the binder to prepare a heterogeneous photoconductive composition. A general discussion of such dispersions and their preparation appears in U.S. Pat. No. 3,253,914 (issued May 31, 1966 to G. Schaum).

Organic photoconductors demonstrate widely varying degrees of solubility in organic solvents used to dissolve many of the common binders. In the preparation of homogeneous photoconductive insulating compositions, organic photoconductors such as polyphenyls and others of low solubility in popular solvents cannot usually be included in sufficient concentration to provide compositions of desirable light-sensitivity. By use of dispersion techniques such as those referred to previously, heterogeneous photoconductive insulating compositions having higher concentrations of low solubility photoconductors can be obtained, the objective being to improve light-sensitivity in the composition.

Heterogeneous organic photoconductive compositions as discussed herein can be advantageous, especially in the preparation of electrophotographic elements on which visible images will be provided. For example, elements comprising such compositions are both lighter in weight than elements having inorganic photoconductive compositions comprising, for example, zinc oxide, and can be prepared to resemble bond paper.

Organic photoconductors known to the art include p-terphenyl and p-quaterphenyl. These compounds are particularly attractive in terms of color, weight, stability and the like. However, as with other organic photoconductors employed in heterogeneous compositions, they have not enjoyed the popularity of photoconductive insulating compositions using inorganic photoconductors. This is attributable either to their low photoconductivity or, if sufficient in that regard, to their high cost. For example, when p-terphenyl is dispersed in a binder, the resulting composition is less photoconductive than a similar dispersion of p-quaterphenyl. P-Terphenyl, however, is by far the less expensive of the two. Moreover, compositions of simple mixtures of these p-terphenyl and p-quaterphenyl in a binder, as disclosed generally in U.S. Pat. No. 3,287,123 (issued Nov. 22, 1966 to Helmut Hoegl), offer at best only a weighted average photoconductive response based on the proportion of each photoconductor in the mixture. In fact, such mixtures appear unable to provide any of the higher photoconductive response characteristics of p-quaterphenyl if p-quaterphenyl is present in an amount less than about 10 percent of the weight of the mixture. Furthermore, significant improvement in photoconductivity often does not occur in compositions comprising such simple mixtures until the proportion of the p-quaterphenyl is so high as to be economically unacceptable.

SUMMARY OF THE INVENTION

In accordance with the invention, there is provided a co-crystalline photoconductor comprising p-terphenyl doped with p-quaterphenyl, a heterogeneous photoconductive insulating composition comprising such co-crystalline photoconductor dispersed in an electrically insulating binder, and a preferred method for preparing the co-crystalline photoconductor. Co-crystalline p-terphenyl and p-quaterphenyl, as defined, unexpectedly exhibits higher photoconductivity than an otherwise identical simple mixture of p-terphenyl and p-quaterphenyl. Furthermore, it has been established that co-crystalline p-quaterphenyl-doped p-terphenyl can be objectively distinquished from simple mixtures of p-terphenyl and p-quaterphenyl by x-ray diffraction analysis. In particular co-crystalline photoconductors in accordance with this invention exhibit greater x-ray diffraction peak widths measured at half-maximum intensity for the (112) diffraction peak compared to undoped p-terphenyl controls. Mixtures of p-terphenyl and p-quaterphenyl, on the other hand, exhibit no corresponding (112) peak width increases.

In accordance with a preferred method of preparing the co-crystalline organic photoconductors described above, there is provided a sequence of steps comprising (a) dissolving preselected amounts of p-terphenyl and p-quaterphenyl in a common solvent to form a solution, and thereafter co-crystallizing the dissolved materials from the solution to form the desired photoconductor. A most preferred method of co-crystallization comprises evaporating substantially all of the solvent from the aforementioned solution, although simple cooling will give the same desired results.

DETAILED DESCRIPTION OF THE INVENTION

The compounds p-terphenyl and p-quaterphenyl, are well known organic photoconductors. As previously indicated, if these two compounds are physically mixed and thereafter dispersed in an insulating binder, the photoconductive response of the composition, as expected, is an average according to the proportion of each compound in the mixture. It has now been found, in accordance with the invention, that co-crystalline photoconductors comprising p-terphenyl doped with p-quaterphenyl exhibit greatly enhanced photoconductivity compared to otherwise identical mixtures of p-terphenyl and p-quaterphenyl. That is, when particles of the present co-crystalline organic photoconductor are dispersed in an electrically insulating binder, the resulting heterogeneous photoconductive composition exhibits greater photoconductive speed than an otherwise identical heterogeneous composition having a simple mixture of the same p-terphenyl and p-quaterphenyl constituents of the co-crystalline photoconductor.

The term co-crystalline as used herein refers to the unit crystal lattice of p-terphenyl doped with p-quaterphenyl. It is believed that in such unit, one or more crystal lattice sites are occupied by p-quaterphenyl molecules, the remaining majority of sites being occupied by p-terphenyl molecules. Co-crystalline photoconductors of this invention, moreover, exhibit characteristic x-ray diffraction patterns so as to enable their identification. That is, the diffraction patterns of co-crystalline p-terphenyl/p-quaterphenyl are different from undoped p-terphenyl (or simple mixtures of p-terphenyl with other photoconductors such as p-quaterphenyl). In this regard, it has been observed that the diffraction peaks in the (112) maximum (corresponding to an observed d-spacing of 3.18Å or a copper irradiation Bragg angle, $2\theta$, of about 28°) for p-terphenyl doped with up to about 15 percent p-quaterphenyl, are wider than the corresponding (112) peaks for undoped terphenyl. In determining peak width, measurement is made at half-maximum intensity of the (112) peak. Comparison is then made with the corresponding peak width of undoped p-terphenyl to determine peak width increase.

The (112) or 3.18Å peak as used herein is characteristic of the monoclinic unit cell defined for p-terphenyl in *Powder Diffraction File Search Manual*, 1976, published by the Joint Committee on Powder Diffraction Standards, Swarthmore, Pa., in particular, data card 22-1838.

X-ray diffraction patterns can be determined by any conventional technique. A particularly useful technique employed herein consisted of generating x-ray diffraction patterns of intensity or counting rate versus Braff angle $2\theta$ for pressed discs of air ground samples of p-terphenyl doped with p-quaterphenyl, simple mixtures of p-quaterphenyl and p-terphenyl, and undoped p-terphenyl controls. Discs were prepared by air grinding the samples using a 2 inch Sturtevant Micronizer to produce a fine powder, and pressing the resulting powder into nominally 0.042" (1.0 mm) thick discs at a pressure of about 11,000 psi. Next, the diffraction patterns for the disced samples were determined with a Siemens diffractometer having ½° divergence and 0.2 mm detector slits, and equipped with a scintillation counter. The x-radiation used was copper K$\alpha$ radiation with a wavelength of 1.5418Å. Having generated the appropriate pattern for a given sample, the width of the (112) peak in Bragg angle degrees at half-maximum intensity was determined and compared against an undoped p-terphenyl control.

Results of the foregoing technique clearly indicated that in going from an undoped p-terphenyl control to a 2% p-quaterphenyl-doped p-terphenyl sample, the (112) peak width at half-maximum increased from about 0.42 degrees $2\theta$ for the control to about 0.48 degrees $2\theta$ for the sample. At 5, 10 and 15 percent p-quaterphenyl doping levels, moreover, the (112) peak width increased to 0.49, 0.50, and 0.47 degrees $2\theta$ respectively. Otherwise identical simple mixtures of p-quaterphenyl and p-terphenyl registered no increase in (112) peak widths under the same x-ray diffraction analysis technique.

While reference has been made above to x-ray diffraction analysis employing a Siemens diffractometer, other techniques and apparatus may be employed. Useful techniques are described in several textbooks including "X-Ray Diffraction Procedures for Polycrystalline and Amorphous Materials", (2nd Edition, by H. P. Klug and L. E. Alexander, John Wiley & Sons, New York, 1974). An apparatus that has been found useful for characterizing p-terphenyl doped with low percentages of p-quaterphenyl, such as around the 1 percent doping levels, is the Nonius Guinier de Wolff camera. X-ray diffraction patterns produced are recorded by the Guinier camera on photosensitive film as band patterns of varied intensities. Through the use of a microdensitometer, a plot of intensity versus Bragg angle (or observed d-spacing) can subsequently be generated to enable (112) peak width analysis as above described.

In rendering an analysis by the Siemens diffractometer, one should note that the thickness of the sample disc can affect the observed (112) peak width. For best comparisons, therefore, the p-terphenyl control disc and the sample disc should be the same. However, peak width tends to increase as disc thickness increases, so that if the sample disc, for example, is thinner than the control, any increase in (112) peak width of the sample compared to the control would be understated.

Various concentration levels of p-quaterphenyl dopant can be employed in the co-crystalline photoconductors of this invention. Useful results, that is in terms of useful photoconductive speed, can be obtained with from about 1 to 15 percent p-quaterphenyl doping by weight of p-terphenyl although amounts of p-quaterphenyl doping outside this range may also be used. Preferred levels of doping are from about 2 to 5 percent p-quaterphenyl.

The invention can also be viewed as a method of improving the photoconductive speed of p-terphenyl crystals by doping with p-quaterphenyl as described. Attempts to improve the speed of p-terphenyl by doping with other organic photoconductors such as anthracene, 1,1,4,4-tetraphenyl butadiene, and the like were unsuccessful resulting in speed decreases for the p-terphenyl so doped (see Table III hereinafter). Thus, from another standpoint, p-quaterphenyl-doped p-terphenyl represents a unique combination per se as evidenced by the photoconductive performance of such co-crystalline material.

The co-crystalline photoconductors of this invention can be formed by a number of techniques including co-crystallization of the two components from solution in a common solvent. Typically the co-crystalline material is precipitated, for example, by subsequent evaporation of solvent.

Suitable solvents for carrying out the above method include toluene, xylene, and the like. Preferred solvents are those having certain solubility parameters and which impart high photoconductive speed to p-terphenyl by crystallization. Such preferred solvents include acetic acid, acetone, ethyl acetate, butyl acetate, 2-propanol, and the like as described in copending U.S. Patent Application Ser. No. 800,601 entitled P-TERPHENYL ORGANIC PHOTOCONDUCTORS AND HETEROGENEOUS COMPOSITIONS THEREOF filed concurrently herewith in the name of Richard S. Vickers. Selection of solvent, of course, is premised on the solvent's being able to act as a common solvent to both p-quaterphenyl and p-terphenyl.

The manner in which the p-terphenyl and p-quaterphenyl to be co-crystallized are dissolved can vary but in general heating the solvent enhances such dissolution. Heating the solvent is also advantageous in that solvent evaporation rate (if evaporation techniques are employed) is increased during the actual co-crystallization.

The co-crystalline organic photoconductors of the invention can be formed by evaporating the solution of p-terphenyl and p-quaterphenyl in a common solvent. During evaporation it is desirable to pass inert gas, such as air, over the liquid surface of the solution. Although not essential, in some instances evaporating the solution to complete dryness may be preferred. In those cases, prolonged heating, e.g., for 24 hours or more at moderate temperatures, can be employed. A vacuum can simultaneously be applied over the residue to aid in drying. On the other hand, instead of evaporation, cooling of the solution to room temperature and subsequent filtering of the co-crystalline residue is equally effective to obtain the desired photoconductors of the invention.

Having formed co-crystalline organic photoconductors of p-terphenyl doped with p-quaterphenyl as defined, the resulting co-crystalline material can be, according to another embodiment of the invention, dispersed in an electrically insulating binder to form a heterogeneous photoconductive insulating composition. These compositions are highly desirable when coated on electrically conducting supports, particularly conducting paper supports, as described in greater detail hereinafter.

Sensitizers can be included in the present photoconductive insulating compositions. Useful sensitizers include spectral sensitizers, which are intended primarily to make the photoconductor light-sensitive to spectral regions not within the region of its inherent sensitivity; and chemical sensitizers that serve primarily to increase light-sensitivity of the photoconductor in the spectral region of its inherent sensitivity as well as in those regions to which it may have been spectrally-sensitized.

Representative chemical sensitizers include polymeric sensitizers having monovalent side groups of the chlorendate radical, such as polyvinylchlorendate and others described in greater detail in copending U.S. patent application Ser. No. 800,594 entitled POLYMERIC CHEMICAL SENSITIZERS FOR ORGANIC PHOTOCONDUCTIVE COMPOSITIONS by John M. McCabe et al and filed concurrently herewith; hexachlorocyclopentane chemical sensitizers in combination with cellulose nitrate as described in copending U.S. patent application Ser. No. 800,483 entitled HEXACHLOROCYCLOPENTENE CHEMICAL SENSITIZERS FOR HETEROGENEOUS ORGANIC PHOTOCONDUCTIVE COMPOSITIONS by William E. Yoerger and filed concurrently herewith; quinoxalines and halogenated quinoxalines like 2,3,6-trichloroquinoxaline and others in combination with cellulose nitrate disclosed in copending U.S. patent application Ser. No. 800,587 entitled $\pi$-DEFICIENT N-HETEROAROMATIC CHEMICAL SENSITIZERS FOR HETEROGENEOUS ORGANIC PHOTOCONDUCTIVE COMPOSITIONS by William E. Yoerger and filed concurrently herewith. Other chemical sensitizers include mineral acid; carboxylic acids such as maleic, di- and trichloroacetic acids, and salicylic acids; sulfonic acids and phosphoric acids; and electron acceptor compounds as disclosed by H. Hoegl in *J. Phys. Chem.*, 69, No. 3, pages 755–766 (March, 1965) and in U.S. Pat. No. 3,232,755.

Spectral sensitizers can be included in the present photoconductive insulating compositions, which are intended primarily to make the photoconductor light-sensitive to spectral regions not within the region of its inherent sensitivity. Spectral sensitizers can be chosen from a wide variety of materials such as pyrylium dye salts inclusive of thiapyrylium and selenapyrylium dye salts such as those described in U.S. Pat. No. 3,250,615 (issued May 10, 1966 to C. C. Natali et al); the benzopyrylium type sensitizers described in U.S. Pat. No. 3,554,745 (issued Jan. 12, 1971 to J. A. Van Allan); and defensive publication T-899,023 (published Aug. 31, 1971 to G. A. Reynolds et al); or the cyanine, merocyanine or azacyanine dyes described in U.S. Pat. No. 3,597,196 (issued Aug. 3, 1971 to C. J. Fox et al).

Preferred spectral sensitizers for use with the present photoconductive compositions include the benzopyrylium dye cation 4-(thiaflavylidylmethylene)-flavylium and/or the cyanine dye cation 1,3-diethyl-2-2-(2,3,4,5-tetraphenyl-3-pyrrolyl)vinyl-1Himidazo 4,5-b quinoxalinium.

In compositions of the subject type, chemical sensitizers are usually included in an amount of about 0.1% to about 10% by weight of the photoconductor. Spectral sensitizers are usually present in the composition in an amount of about 0.001% to about 0.1% by weight of the photoconductor. Wider ranges can be useful. In the case of spectral sensitizers, however, unduly high concentrations can produce color that is apparent to the eye and undesirably change the appearance of compositions that are intended to provide a white background.

Useful binders employed in the heterogeneous photoconductive compositions of the invention comprise polymers having fairly high dielectric strength and which are good electrically insulating film-forming vehicles. Materials of this type comprise styrene-butadiene copolymers; silicone resins; poly(vinyl chloride); poly(vinylidene chloride); vinylidene chloride-acrylonitrile copolymers; poly(vinyl acetals) such as poly(vinyl butyral); polyacrylic and polymethacrylic esters such as poly(methylmethacrylate), poly(n-butylmethacrylate), poly)isobutyl methacrylate), etc.; polystyrene; nitrated polystyrene; polymethylstyrene; isobutylene polymers; polyesters, such as poly(ethylenealkaryloxyalkylene terephthalate); phenolformaldehyde resins; ketone resins; polyamides; polycarbonates; etc.

A preferred binder is cellulose nitrate. The choice of cellulose nitrate binder is variable, and cellulose nitrates having a nitrogen content of up to about 13 weight percent as shown by elemental analysis are preferred. Cellulose nitrate having a nitrogen content from about 11.5 to about 13 percent is especially preferred. A wide range of cellulose nitrates, at different viscosities and different nitrogen contents, is available. Many such materials are discussed in *Nitrocellulose, Properties and Uses,* Hercules Powder Co., (1955). The cellulose nitrate binder should be soluble in a solvent or solvent mixture that has little or no solvent action on the organic photoconductor. Alcohol soluble cellulose nitrate is preferred, such as that which exhibits appropriate solubility in lower alcohols like methanol.

Most preferred binders employed in the practice of the invention comprise acrylic polymers such as polyacrylates; polymethacrylates; polyalkylmethacrylates including polymethyl- and polyethylmethacrylates, and the like; polyalkylacrylates including polymethyl- and polyethylacrylates, and the like; polyacrylic acid; polymethacrylic acid; polyalkylacrylic acids; and polyalkylmethacrylic acids. Acrylic binders are desirable by virtue of their availability and resistence to abrasion (hardness). In addition, homopolymers comprising any of the above noted acrylic polymers, and copolymers of these acrylics with either an acrylic polymer or another type polymer can be employed. Especially preferred polymers are copolymers of an acrylate with either acrylic or alkylacrylic acid, such as a copolymer of methylmethacrylate with either methacrylic acid or acrylic acid.

Matting agents may be included to advantage in the present photoconductive insulating compositions. A matting agent tends to avoid glossiness that might otherwise be obtained in layers prepared using the subject compositions and thereby enhances the "plain paper" appearance and feel that can characterize electrophotographic elements of this invention that use a paper support. Further, matting agents can improve the capability of such layers to receive information written or otherwise marked on the layer. Matting agents are preferably electrically inert and hydrophobic so as not to interfere with chargeability, charge retention or other parameters affecting electrophotographic imaging. Methacrylate and polyethylene beads are described in U.S. Pat. No. 3,810,759 (issued May 14, 1974 to T. H. Morse et al) as matting agents. Silicon containing materials are described as matting agents in U.S. Pat. No. 3,652,271 (issued Mar. 28, 1972 to D. M. Bornarth). An especially preferred silicon based matting agent is an inorganic oxide pigment, such as fumed silicon dioxide, that has been chemically modified to render it hydrophobic by reaction with an organic compound like a silane to substitute hydrocarbylsilyl or other hydrophobic groups for the hydroxyl groups originally on the silicon dioxide chain. The fumed silica or other inorganic oxide pigment can be reacted conveniently with an appropriate silane, such as a halotrialkylsilane, merely by contact in solution. A preferred silane is chlorotrimethylsilane and incorporation of the silane in an amount of about 5 to about 15% by weight of the inorganic pigment is especially desirable. It is considered that other inorganic pigments like titanium dioxide and aluminum oxide, as well as clays, could be modified similarly by reaction with a silane to provide useful matting agents. Matting agents can be employed in a wide range of particle sizes and concentrations to provide the desired degree of surface texture. It is also well known in the art to consider the thickness of the layer comprising the matting agent when selecting matting agent of a given particle size. See, for example, the aforementioned U.S. Pat. No. 3,652,271 and U.S. Pat. No. 3,519,819 issued July 7, 1970 to E. P. Gramza et al. It should be emphasized that such matting agents can be used to advantage in a wide range of homogeneous and heterogeneous photoconductive insulating compositions.

Heterogeneous photoconductive insulating compositions of the present invention can be prepared merely by dispersing the co-crystalline photoconductor having the desired particle dimensions in a solution that contains the binder, and also any other constituents, e.g., spectral sensitizers, matting agents, etc., to be included in the composition. The binder's solvent should not have solvent action with respect to the photoconductor, neither should the photoconductor dissolve or swell in the presence of the binder solvent. After addition of the particulate co-crystalline photoconductor, the heterogeneous composition is usually stirred or otherwise mixed thoroughly to assure reasonable uniformity of the dispersion. As used herein, co-crystalline photoconductors desirably have a maximum particle diameter ranging from about 0.1 micron to about 20 microns with from about 0.1 micron to about 10 microns being preferred. If the photoconductor has not been ball-milled or otherwise processed to an appropriate particle size prior to its dispersion in the binder, a heterogeneous composition of the invention can be prepared and thereafter agitated in the presence of stainless steel balls or other agent effective to produce a milling action that causes attrition in the particle size of the photoconductor.

In the alternative, the photoconductor can be dispersed in a non-solvent that is a solvent for the binder of choice and ball-milled to provide photoconductor particles of a size appropriate for use in the present photoconductive insulating compositions. Sensitizers to be included in the composition can be added to the photoconductor dispersion prior to such ball-milling. After this first ball-milling stage, the binder can be added, usually in the form of a solution. The composition is preferably again milled to obtain a uniform dispersion.

In the present compositions, the photoconductor is desirably included in an amount of at least about 40% by weight of solids in the composition and may range to 95 weight percent and higher depending on the particular application. Generally the binder need only be present in an amount sufficient to provide adhesion between particles in the composition and between the composition and the support when the composition is coated on a support. In various preferred embodiments, the photoconductor and any sensitizers, matte agents or other adjuvants constitute between about 70 and 90% by weight of solids in the composition.

As indicated above, the photoconductive insulating composition is usually prepared as a solution of the binder containing other components of the composition including dispersed photoconductive particles. In such form, the composition can be formed into a self-supporting member or it can be coated on an electrically conducting support to provide an electrophotographic element. For purposes of coating, the compositions desirably range from about 20 weight percent solids to about 40 weight percent solids. If extrusion hopper coating is to be used, the most useful solids content of the composition is usually between about 20 and 30 weight percent. For doctor blade coating, from about 30 to about 40 weight percent solids is preferred. Wider ranges may be appropriate depending on conditions of use. In preparing the compositions for purposes such as ball milling and coating, it may be desirable to use a solvent blend to provide optimal viscosity, ease of solvent removal or the like. Acetonitrile, furthermore, can be desirable in combination with methanol to provide a solvent mixture for the binders discussed herein.

In applying the photoconductive insulating compositions on a surface or support, they are usually coated by means, such as extrusion hoppers, doctor blade coaters or whirler coating apparatus, at a coverage sufficient to provide a layer of from 10 to about 25 microns thick when dry, although layers of lesser or greater thickness are also useful. The dry thickness for any given wet thickness as coated will depend in part on the size of the photoconductive particles in the composition and on the amount of void volume, if any, in the layer. Coverages of from about 2.0 to about 15 grams per square meter of support are often used.

In electrophotographic elements it may also be desirable to include one or more photoconductive composition layers in addition to the photoconductive layer comprising co-crystalline photoconductor as described. In such instances, the several photoconductor layers are normally adjacent one another to form so-called "composite" layers.

It is generally recognized in such arrangements that one of the photoconductor layers in the composite serves as a charge-generating layer, while the adjacent photoconductive layer serves as a charge-transport layer. P-quaterphenyl, for example, can be employed in one photoconductive layer adjacent to the co-crystalline photoconductive layer of this invention. Preferably, the p-quaterphenyl layer is outermost and closest to the light source. Composite layers such as those comprising respectively p-quaterphenyl and co-crystalline photoconductor layers are useful regardless of the polarity of charge imposed on the illuminated surface.

Suitable supporting materials on which can be coated photoconductive layers comprising the photoconductive compositions described herein include any of the wide variety of electrically conducting supports, for example, paper (at a relative humidity above 20 percent); aluminum-paper laminates; metal foils such as aluminum foil, zinc foil, etc.; metal plates such as aluminum, copper, zinc, brass and galvanized plates; vapor deposited metal layers such as silver, nickel, aluminum, electrically conducting metals intermixed with protective inorganic oxides, such as Cr intermixed with SiO (as in U.S. Pat. No. 3,880,657 issued Apr. 29, 1975 to A. Rasch) coated on paper or photographic film bases such as cellulose acetate, polystyrene, polyester, etc. Such conducting materials as nickel can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without insulating barrier layers are described in U.S. Pat. No. 3,245,833 by Trevoy, issued Apr. 12, 1966. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. Nos. 3,007,901 by Minsk, issued Nov. 7, 1961 and 3,262,807 by Sterman et al, issued July 26, 1966. Another useful support is paper or other fibrous material as described in U.S. Pat. No. 3,814,599 (issued June 4, 1974 to D. A. Cree), particularly in Columns 2 and 3 of the patent.

Photoconductive compositions according to the present invention can be employed in electrophotographic elements useful in any of the well known electrophotographic processes which require photoconductive layers. One such process is the xerographic process. In a process of this type, an electrophotographic element is held in the dark and given a blanket electrostatic charge by placing it under a corona discharge. This uniform charge is retained by the layer because of the substantial dark insulating property of the layer, i.e., the low conductivity of the layer in the dark. The electrostatic charge formed on the surface of the photoconductive layer is then selectively dissipated from the surface of the layer by imagewise exposure to light by means of a conventional exposure operation such as, for example, by a contact printing technique, or by lens projection of an image, and the like, to thereby form a latent electrostatic image in the photoconductive layer. Exposing the surface in this manner forms a pattern of electrostatic charge by virtue of the fact that light energy striking the photoconductor causes the electrostatic charge in the light struck areas to be conducted away from the surface in proportion to the intensity of the illumination in a particular area.

The charge pattern produced by exposure is then developed or transferred to another surface and developed there, i.e., either the charged or uncharged areas rendered visible, by treatment with a medium comprising electrostatically responsive particles having optical density. The developing electrostatically responsive particles can be in the form of a dust, i.e., powder, or a pigment in a resinous carrier, i.e., toner. A preferred method of applying such toner to a latent electrostatic image for solid area development is by the use of a magnetic brush. Methods of forming and using a magnetic brush, toner applicator are described in the following U.S. Pat. Nos.: 2,786,439 by Young, issued Mar. 26, 1957; 2,786,440 by Giaimo, issued Mar. 26, 1957; 2,786,441 by Young, issued Mar. 26, 1957; 2,874,063 by Greig, issued Feb. 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example, U.S. Pat. No. 2,907,674 by Metcalfe et al, issued Oct. 6, 1959. In dry developing processes, the most widely used method of obtaining a permanent record is achieved by selecting a developing particle which has as one of its components a low-melting resin. Heating the power image then causes the resin to melt or fuse into or on the element. The powder is, therefore, caused to adhere permanently to the surface of the photoconductive layer. In other cases, a transfer of the electrostatic charge image formed on the photoconductive layer can be made to a second support such as paper which would then become the final print after development and fusing. Techniques of the type indicated are well known in the art and have been described in the literature such as in "RCA Review", Volume 15 (1954), pages 469–484.

Because the electrophotographic elements described herein can be developed in a liquid environment, as above described, the non-photoconductive surface of the element, i.e., that side of the support opposite the side carrying the photoconductive layer, can be overcoated with a so-called solvent hold-out layer. One or more of these layers serve to reduce or eliminate penetration of solvent or liquid carriers into the paper support during development. A typical hold-out layer can include pigments, pigment dispersing agents, clays, latices such as styrene-butadiene latex, polyvinylalcohol, and the like, in various proportions to give the desired result.

H and D electrical speeds to indicate the photoconductive response of electrophotographic materials such as those discussed herein can be determined as follows: The material is electrostatically charged under, for example, a corona source until the surface potential, as measured by an electrometer probe, reaches some suitable initial value $V_o$, typically from 100 to about 600 volts. The charged element is then exposed to a 3000° K. tungsten light source or a 5750° K. xenon light source through a stepped density gray scale. The exposure causes reduction of the surface potential of the element under each step of the gray scale from its initial potential $V_o$ to some lower potential V the exact value of which depends upon the amount of exposure in meter-candle-seconds received by the area. The results of these measurements are then plotted on a graph of surface potential V vs. log exposure for each step, thereby forming an electrical characteristic curve. The electrical or electrophotographic speed of the photoconductive composition can then be expressed in terms of the reciprocal of the exposure (in meter-candle-seconds) required to reduce the initial surface potential $V_o$ to any fixed selected value, typically $\frac{1}{2} V_o$. An apparatus useful for determining the electrophotographic speeds of photoconductive compositions is described in Robinson et al, U.S. Pat. No. 3,449,658, issued June 10, 1969. The above procedure was employed in the examples below.

The following examples are included to illustrate the present invention.

EXAMPLE 1

To 10 g. of scintillation grade p-terphenyl dissolved in 450 ml of hot toluene was added one of the following:

A. nothing.

B. 0.2 g (2% based on weight of p-terphenyl) of p-quaterphenyl dissolved in 450 ml of hot toluene.

C. 0.5 g (5% based on weight of p-terphenyl) of p-quaterphenyl dissolved in 1400 ml of hot toluene.

D. 1.0 g of p-quaterphenyl dissolved in sufficient hot toluene to form a solution.

E. 1.5 g of p-quaterphenyl dissolved in sufficient hot toluene to form a solution.

In A, B, C, D, and E, the respective solutions formed were stirred until complete solution resulted. Air was then passed over each liquid surface to evaporate substantially all solvent. Under these conditions, crystallization took place in each of the solutions. The crystalline residue from each was then heated in a 60° C. vacuum over for 24 hours to remove residual solvent.

F. In addition, a mixture was prepared by combining, in the absence of solvent, 10 grams of p-terphenyl and 0.5 grams of p-quaterphenyl.

The crystalline residues of A–E were analyzed b x-ray diffraction analysis to determine (112) peak width at half-maximum intensity in accordance with the Siemens diffractometer technique outlined above. Results are shown in Table I.

TABLE I

| | Sample | Disc Thickness | (112) Peak Width in Degrees 2θ |
|---|---|---|---|
| A | (100% p-terphenyl) | .042 inches | 0.42 degrees |
| B | (2% p-quaterphenyl dopant) | .039 inches | 0.48 degrees |
| C | (5% p-quaterphenyl dopant) | .038 inches | 0.49 degrees |
| D | (10% p-quaterphenyl dopant) | .039 inches | 0.50 degrees |
| E | (15% p-quaterphenyl dopant) | .038 inches | 0.47 degrees |

Table I illustrates the increase in (112) peak width characteristic of co-crystalline photoconductors of this invention having from 2 to 15 percent p-quaterphenyl doping. It should be noted that with the Siemens diffractometer a (112) peak width increase was not observed for p-terphenyl doped with 1% p-quaterphenyl. However, by using a Guinier camera, a (112) peak width was observed for 1% doping levels.

To a 2.0 ram sample of the residue from A, a 2.02 gram sample of the residue from B, a 2.05 gram sample of the residue from C, and a 2.05 gram sample of the mixture from F, was added 0.715 g cellulose nitrate (grade RS ¼ sec supplied as 70 percent solids in isopropanol by Hercules Powder Company), 20 mg of 2,3,6-trichloroquinoxaline (chemical sensitizer), and 8 ml of a dye solution consisting of 0.003 g. of 4-(thiaflavylidylmethylene)-flavylium chloride in 120 ml of methanol (spectral sensitizer).

The formulations of the preceding paragraph were individually placed in a screw-cap vial containing 20 g of 3 mm stainless steel balls and milled for 2 hours with a reciprocating paint shaker. The resulting dispersions were coated at a wet thickness of about 0.1 mm on a polyester support bearing a conducting layer of vacuum deposited nickel, and thereafter dried to produce electrophotographic elements. Samples of elements from each of A, B, C, and F were charged to 300 volts (positive polarity) and thereafter exposed to a 3000° K. tungsten light source for a time sufficient to discharge exposed regions to +150 volts. The relative electrical speed of the element from A was arbitrarily designated 100 and the speeds of B, C, and F determined relative to the speed of A. Results are tabulated in Table IA.

TABLE IA

| | Sample | Relative Electrical H&D Speed |
|---|---|---|
| A | (100% p-terphenyl) | 100 |
| B | (2% p-quaterphenyl) | 175 |
| C | (5% p-quaterphenyl | 196 |
| F | (ordinary mixture of | 100 |

TABLE IA-continued

| Sample | Relative Electrical H&D Speed |
|---|---|
| p-terphenyl with 5% p-quaterphenyl) | |

The results in Table IA indicate the uniqueness of co-crystalline photoconductors in accordance with the invention.

EXAMPLE 2

In a separate preparation of co-crystalline photoconductor consisting of p-terphenyl doped with 2% p-quaterphenyl, acetic acid and toluene were separately employed as the crystallizing solvents. The resulting co-crystalline photoconductors were formulated into heterogeneous photoconductive compositions in a manner similar to that of Example 1 and evaluated for photoconductive speed relative to an otherwise identical control composition comprising undoped p-terphenyl. The control speed was arbitrarily designated 100. The relative speed of the composition comprising photoconductor co-crystallized from toluene was 135; the speed of the composition comprising photoconductor co-crystallized from acetic acid was 182.

EXAMPLE 3

A, B, and C from Example 1 were formulated into dispersions as in Example 1 except that 20 mg of polyvinylchlorendate chemical sensitizer (50.6 percent Cl) and 20 g of 2.5 mm zirconium oxide milling media were substituted for the 2,3,6-trichloroquinoxaline and stainless steel milling media respectively. In addition, a comparable dispersion of p-quaterphenyl was formulated employing the above substituted materials. The dispersions of this example were then formed into electrophotographic elements and tested as in Example 1. Results are tabulated in Table II.

TABLE II

| Sample | Relative Electrical H&D Speed |
|---|---|
| A | 100 |
| B | 133 |
| C | 138 |
| 100% p-quaterphenyl | 150 |

EXAMPLE 4

To illustrate the unexpected behavior of p-quaterphenyl as a p-terphenyl dopant, 9.8 gram samples of p-terphenyl were co-crystallized with the addenda listed in Table III below.

The co-crystalline materials of this example, the addenda below listed, and p-terphenyl were formulated into respective electrophotographic elements as in Example 3. Electrical H & D speed evaluation of all elements followed using the 100% terphenyl element as a control with an electrical speed arbitrarily assigned as 100. Results are tabulated in Table III.

TABLE III

| Addenda | Relative Electrical H and D Speed |
|---|---|
| (control) | 100 |
| p-quaterphenyl | 130 |
| tetraphenyl pyrrole | 8 |
| 1,1,4,4-tetraphenyl butadiene | 53 |
| anthracene | 14 |
| O-terphenyl | 90 |
| m-terphenyl | 83 |
| biphenyl | 90 |
| 3,3'-diphenyl biphenyl | 95 |

TABLE III-continued

| Addenda | Relative Electrical H and D Speed |
|---|---|
| 1,4-bis{2-(5-phenyloxazolyl)}-benzene | 88 |

While the concept of doping p-terphenyl with p-quaterphenyl has been advanced herein, it would also be desirable to dope p-terphenyl with higher polyphenyls such as p-pentaphenyl, p-sexiphenyl etc. to the extent such doping would provide co-crystalline photoconductors exhibiting enhanced photoconductive speed vis-a-vis ordinary mixtures of the same components. P-terphenyl doped with higher polyphenyls would be expected to also exhibit increased peak widths in at least the (112) peak region, as shown by x-ray diffraction pattern analysis.

The invention has been described with particular reference to certain preferred embodiments thereof but it will be understood that variations and modifications can be effected within the spirit and scope of the invention.

What is claimed is:

1. A co-crystalline organic photoconductor comprising p-terphenyl doped with p-quaterphenyl.

2. The co-crystalline photoconductor of claim 1 wherein the concentration of said p-quaterphenyl is in the range from about 1 to 15 percent by weight based on p-terphenyl.

3. The co-crystalline photoconductor of claim 2 wherein said p-quaterphenyl concentration is in the range from about 2 to 5 percent.

4. A method for making a co-crystalline organic photoconductor comprising forming a solution of p-terphenyl and p-quaterphenyl dissolved in a common solvent, and thereafter co-crystallizing said p-terphenyl and p-quaterphenyl.

5. The method according to claim 4 wherein said p-terphenyl and p-quaterphenyl are co-crystallized by evaporating substantially all of said solvent from said solution.

6. The method according to claim 5 wherein said solvent is acetic acid, or acetone, and said p-quaterphenyl is present in said solution in a concentration of about 2 to 5 percent by weight based on p-terphenyl.

7. A heterogeneous photoconductive insulating composition comprising particles of a co-crystalline organic photoconductor comprising p-terphenyl doped with p-quaterphenyl, said particles being dispersed in an electrically insulating binder.

8. The composition according to claim 7 wherein the concentration of said p-quaterphenyl is in the range from about 1 to 15 percent by weight based on p-terphenyl.

9. The composition according to claim 8 wherein said p-quaterphenyl concentration is in the range from about 2 to 5 percent.

10. The composition according to claim 9 comprising additionally a cyanine or benzopyrylium spectral sensitizer.

11. The composition according to claim 9 wherein said binder is an acrylic resin and said composition additionally comprises polyvinylchlorendate chemical sensitizer, and at least one of 4-(thiaflavylidylmethylene)-flavylium and 1,3-diethyl-2-{2-(2,3,4,5-tetraphenyl-3-pyrrolyl)vinyl}-1H-imidazo{4,5-b}quinoxalinium spectral sensitizing dye cations.

12. The composition according to claim 11 wherein the concentration of said co-crystalline photoconductor in said composition is in the range from about 70 to 90 percent by weight based on total solids in said composition.

13. The composition according to claim 9 wherein said binder is a cellulose nitrate.

14. An electrophotographic element comprising an electrically conducting support bearing thereon a layer of a photoconductive insulating composition comprising particles of a co-crystalline photoconductor comprising p-terphenyl doped with p-quaterphenyl, said particles being dispersed in an electrically insulating binder.

15. An electrophotographic element comprising an electrically conducting paper support bearing thereon a layer of a photoconductive insulating composition comprising particles of a co-crystalline photoconductor comprising p-terphenyl doped with from about 2 to 5 percent p-quaterphenyl, by weight based on p-terphenyl; polyvinylchlorendate chemical sensitizer; a matte agent; and at least one of 4-(thiaflavylidylmethylene)-flavylium and 1,3-diethyl-2-{2-(2,3,4,5-tetraphenyl-3-pyrrolyl)vinyl}-1H-imidazo{4,5-b}quinoxalinium spectral sensitizing dye cations.

16. An electrophotographic process comprising applying a uniform charge to the surface of an electrophotographic element, imagewise exposing said charged surface to actinic radiation to form an electrostatic latent image, and developing said latent image to form a visible image, said electrophotographic element being an element as defined in claim 14.

17. An electrophotographic process comprising applying a uniform charge to the surface of an electrophotographic element, imagewise exposing said charged surface to actinic radiation to form an electrostatic latent image, and developing said latent image to form a visible image, said electrophotographic element being an element as defined in claim 15.

18. An electrophotographic copy comprising an element as defined in claim 14 and a visible image pattern on said photoconductive insulating composition layer.

* * * * *

UNITED STATES PATENT AND TRADEMARK OFFICE

CERTIFICATE OF CORRECTION

PATENT NO. : 4,145,214

DATED : March 20, 1979

INVENTOR(S) : William E. Yoerger

It is certified that error appears in the above—identified patent and that said Letters Patent is hereby corrected as shown below:

Column 6, line 56, insert --[-- after "diethyl-2-"; line 57, insert --]-- after "vinyl"; line 57, insert a hyphen after "1H".

Column 12, line 15, after "b"; delete "b" and insert --by--.

Signed and Sealed this

*Twenty-sixth* Day of *August 1980*

[SEAL]

*Attest:*

SIDNEY A. DIAMOND

*Attesting Officer*

*Commissioner of Patents and Trademarks*